US005503068A

United States Patent [19]

Newman

[11] Patent Number: 5,503,068

[45] Date of Patent: Apr. 2, 1996

[54] RETRACTABLE PALLET ATTACHMENT FOR SCREEN PRINTING

[75] Inventor: Don E. Newman, Wyncote, Pa.

[73] Assignee: Stretch Devices, Inc., Philadelphia, Pa.

[21] Appl. No.: 329,022

[22] Filed: Oct. 25, 1994

[51] Int. Cl.[6] ..... B41F 15/16

[52] U.S. Cl. ..... 101/126; 101/127.1; 101/DIG. 36

[58] Field of Search ..... 101/115, 126, 101/127.1, 128, 128.1, 481, 485, 486, DIG. 36; 33/614, 615, 617, 620

[56] References Cited

U.S. PATENT DOCUMENTS

| | | | |
|---|---|---|---|
| 4,911,070 | 3/1990 | Miske et al. | 101/126 |
| 4,938,130 | 7/1990 | Thorpe | 101/126 |
| 4,993,166 | 2/1991 | Bradley | 101/DIG. 36 |
| 5,094,160 | 3/1992 | Jennings | 101/129 |
| 5,094,161 | 3/1992 | Taylor | 101/115 |
| 5,188,026 | 2/1993 | Fuqua et al. | 101/126 |
| 5,226,366 | 7/1993 | Schlife et al. | 101/DIG. 36 |

*Primary Examiner*—Stephen Funk
*Attorney, Agent, or Firm*—Seidel Gonda Lavorgna & Monaco

[57] ABSTRACT

A retractable registration apparatus aligns a printing screen with an image platform. The apparatus has a pair of arms. Each arm extends along a longitudinal axis and has at least two sections with a substantially square cross-section along the longitudinal axis and at least two other sections along the longitudinal axis having a circular cross-section inscribed within the square cross-section. A pair of mounting brackets are associated with each of the arms and each have a substantially square opening extending through the bracket for slideably receiving the substantially square cross-section of the arm. The pair of mounting brackets are mounted to the lower surface of an image platform so that the side walls of each bracket are in the same plane and are parallel to the center line. Each arm has a track formed within the arm, and one of the mounting brackets associated with the arm has a guide pin projecting into the arm for guiding the movement of the arm. The track has portions with a longitudinal component for movement of the arm in a translational movement and has portions having a radial component for rotation of the arm about the axis. A finger extends from the arm and has at least one registration pin for registration with the screen frame. The apparatus has a detent for retaining the arms and the registration pins in the retracted position and a second detent for retaining in the exact registration position the arms and the registration pins for aligning the screen frame.

25 Claims, 8 Drawing Sheets

RETRACTABLE PALLET ATTACHMENT FOR SCREEN PRINTING

FIELD OF THE INVENTION

This invention relates to a retractable registration system for aligning a screen printing frame and screen in a printing machine, and more particularly to a registration system that retracts under the pallet allowing ease of insertion of a substrate, such as a shirt, without removing the registration system.

BACKGROUND OF THE INVENTION

In the majority of screen printing operations, more than one color is used to create the desired image. The use of more than one color results in using several screens, one for each color, wherein each screen has the associated image for that color. It is therefore necessary to ensure that the images from each screen align properly so that the associated colors align properly. This is typically done by ensuring that the screen is properly aligned in a frame and aligning the frame, such as a roller frame, to a platform, such as a pallet, which receives the article that is to receive the image.

One conventional method is to remove the pallet from the screen printing machine and install a fixture that has a series of pins. These pins are used to align the screen printing roller frame and screen in the machine. The screen printing roller frame is mounted on a flat bar having a hole and a slot in which to receive the pins, therein aligning the frame on the pallet. With the screen aligned, a frame holder having a U-shaped channel is secured to the screen printing roller frame, typically by lowering a bracket into engagement with the frame. With the frame secured in the frame holder, the frame and the pallet are moved relative to each other to separate them by either lowering the pallet or raising the frame with the frame holder. Depending on the type of machine either the pallet or the frame holders are rotated and another screen is inserted on the fixture and aligned with a second frame holder. After alignment of all the screens with the frame holder, the printer removes the fixture from the machine and reinstalls the pallet used for printing.

One of the shortcomings, in addition to the time required to remove the pallet and install the fixture, is that the installation and removal of the pallet and the fixture results in wear to those parts used to secure the fixture or pallet to a pallet arm. In addition, the printer must have a location to store the fixture when not being used to align the screen printing roller frame.

It is desired to have a registration system that would allow for quick registration of a screen printing roller frame and screen and in addition allow the registration means to retract without removal from the machine.

SUMMARY OF THE INVENTION

The present invention relates to a retractable registration apparatus for aligning a printing screen carried in a screen printing frame with an image platform having an upper printing surface and a lower printing surface. The apparatus has a bracket mounted to the lower surface of the image platform along the center line for receiving a pillar of the printing machine and a pair of arms. Each arm extends along a longitudinal axis. Each arm has at least two sections with a substantially square cross-section along the longitudinal axis and at least two other sections along the longitudinal axis, having a circular cross-section inscribed within the square cross-section. A pair of mounting brackets are associated with each of the arms. The mounting brackets each have a substantially square opening extending through the bracket for slideably receiving the substantially square cross-section of the arm. The substantially square openings each have a pair of side walls. The pair of mounting brackets are mounted to the lower surface of the image platform so that the one of side walls of each of brackets are aligned in the same plane and are parallel to the center line. Each arm has a track formed within the arm, and one of the mounting brackets associated with the arm has a guide pin projecting into the arm for guiding the movement of the arm. The track has portions with a longitudinal component for movement of the arm in a translational movement and has portions having a radial component for rotation of the arm about the longitudinal axis. A finger extends from the arm and has at least one registration pin for registration with the screen frame. The apparatus has a means for retaining the arms and the registration pins in the retracted position, and means for retaining in the exact registration position, the arms and the registration pins for aligning the screen frame.

One object, feature and advantage of the present invention is that the image platform, such as a pallet, does not have to be removed from the machine in order to install a fixture to align the screen printing roller frame, therein reducing the added wear on the mechanism retaining the pallet to the machine.

Another object, feature and advantage of the present invention resides in the fingers in the retracted position under the pallet do not interfere with the insertion of an article such as a shirt onto the image platform for printing.

Further objects, features and advantages of the present invention will become more apparent to those skilled in the art as the nature of the invention is better understood from the accompanying drawings and detailed descriptions.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown.

DETAILED DESCRIPTION OF THE INVENTION

Figure 1:
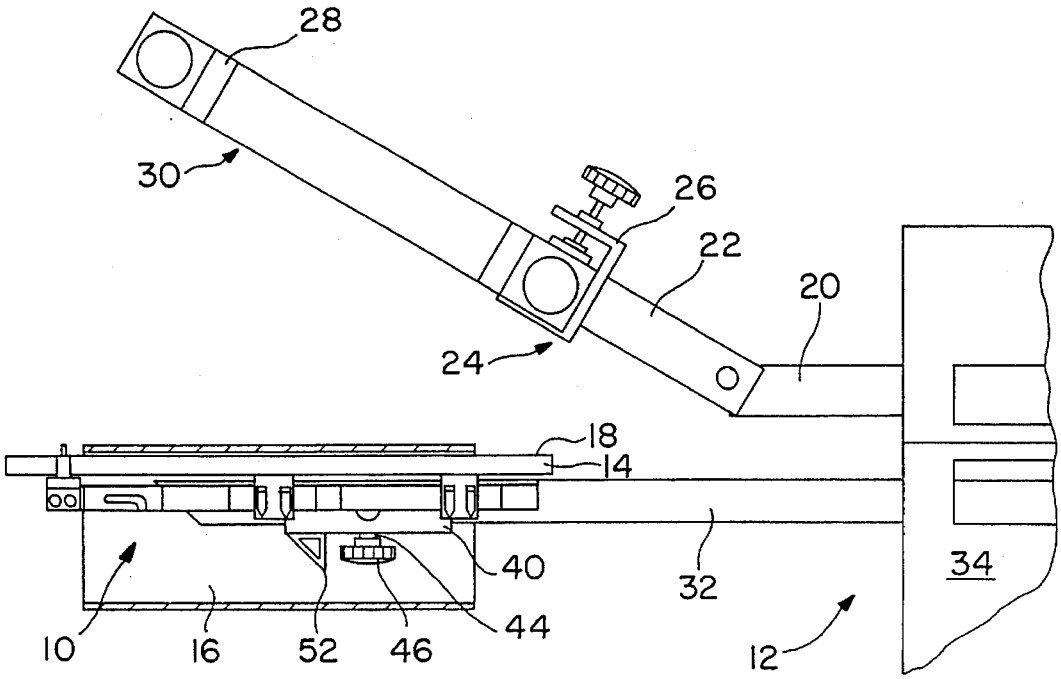
FIG. 1 is a side elevational view of a screen printing machine having an image platform, such as a pallet, of the present invention, and a roller mesh frame screen attached to a frame holder.

Referring to the drawings in detail, where like numerals indicate like elements, there is illustrated a device in accordance with the present invention designated generally as 10.

Referring to FIG. 1, a printing machine 12 has an image platform 14, such as a pallet, for receiving an article 16 to print on, such as a shirt or poster. The portion of the article to be printed on, lies on top of an upper printing surface 18 of the pallet 14. The printing machine 12 has a stationary bar 20 and a movable bar 22. At the end of the movable bar 22 is a frame holder 24 having a U-shaped channel 26. The U-shaped channel 26 of the frame holder 24 receives a screen printing frame, such as a roller frame 28 having a screen 30 which contains an image to be transferred to the shirt 16.

The pallet 14 is linked to the frame holder 24 by a pallet arm 32 extending from a central portion 34 of the printing machine 12 to the pallet 14. The printing machine 12 has a mechanism for separating the frame holder 24 from the pallet 14, and in this embodiment the pivotal movement of the movable bar 22 relative to the stationary bar 20 raises the frame holder 24, with screen printing roller frame 28, away from the pallet 14. In addition, the central portion 34 of the printing machine 12 allows rotation of the pallet 14 and pallet arm 32 relative to the frame holder 24 to move another pallet 14, not shown, underneath the same screen printing roller frame 28 therein moving the pallet 14 to another station that may have another screen printing roller frame.

Figure 2:
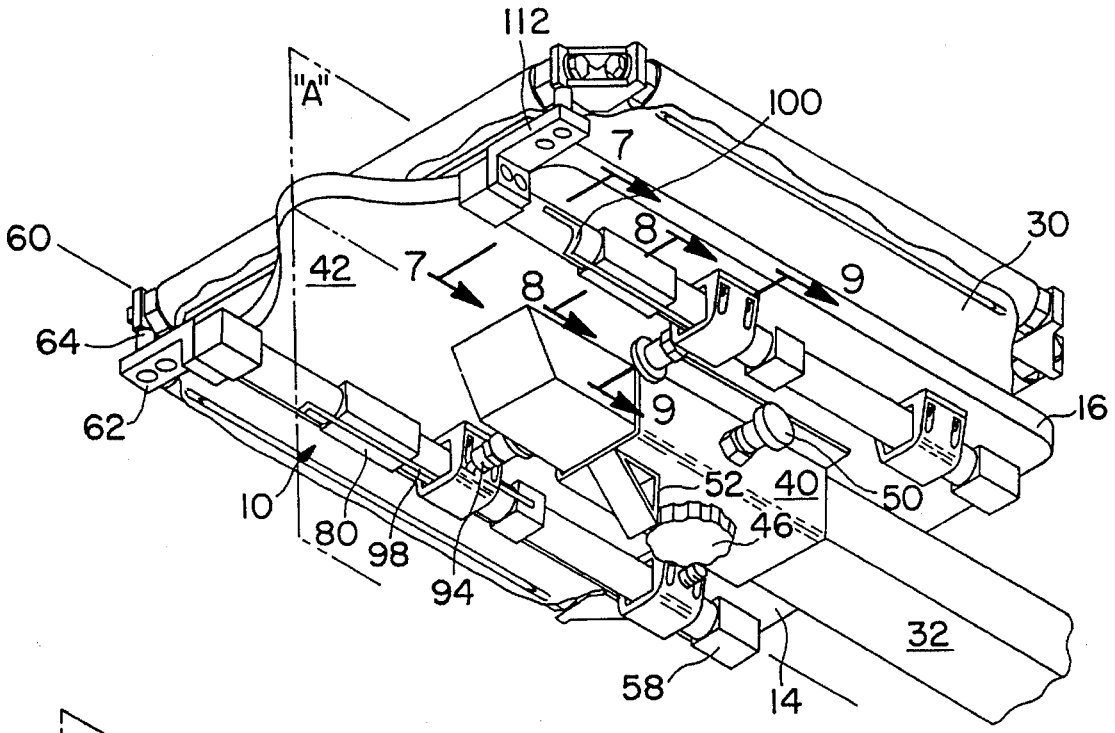
FIG. 2 is a bottom isometric view of the pallet having a pallet arm located in the bracket and the registration appendages in a registered position.

Referring to FIG. 2, the pallet 14 is mounted to the pallet arm 32 by a U-shaped bracket 40 mounted to a lower mounting surface 42 of the pallet 14 along the center line or plane "A" of the pallet 14. The U-shaped bracket 40 has a threaded screw 44, as seen in FIG. 1, with a knurled knob 46 for engaging the pallet arm 32 to secure the pallet 14 in position on the pallet arm 32. The end, not shown, of the threaded screw 44, frictionally engages the pallet arm 32 to hold the pallet 14 relative to the pallet arm 32 and the frame holder 24. In addition, the U-shaped bracket 40 has a second threaded shaft, not shown, with a knurled knob 50 engaging the side of the pallet arm 32 to secure the pallet 14 in position.

The U-shaped bracket 40, in addition, has an angled bracket 52 located in front of knurled knob 46 to ease the placement of article 16, such as a shirt, as seen in FIG. 1, around the pallet 14 to allow printing on the upper printing surface 18. The pallet arm 32 has an angled front, also for ease in placement of the shirt 16 around the pallet 14.

Mounted on the lower mounting surface 42 of the pallet 14 is the retractable registration apparatus 10. The retractable registration apparatus 10 has a pair of registration appendages 56. Each registration appendage 56 has an arm 58 which extends along a longitudinal axis 60. Projecting from the arm 58, perpendicularly to the longitudinal axis 60, is a finger 62 having a plurality of pins 64.

Figure 5:
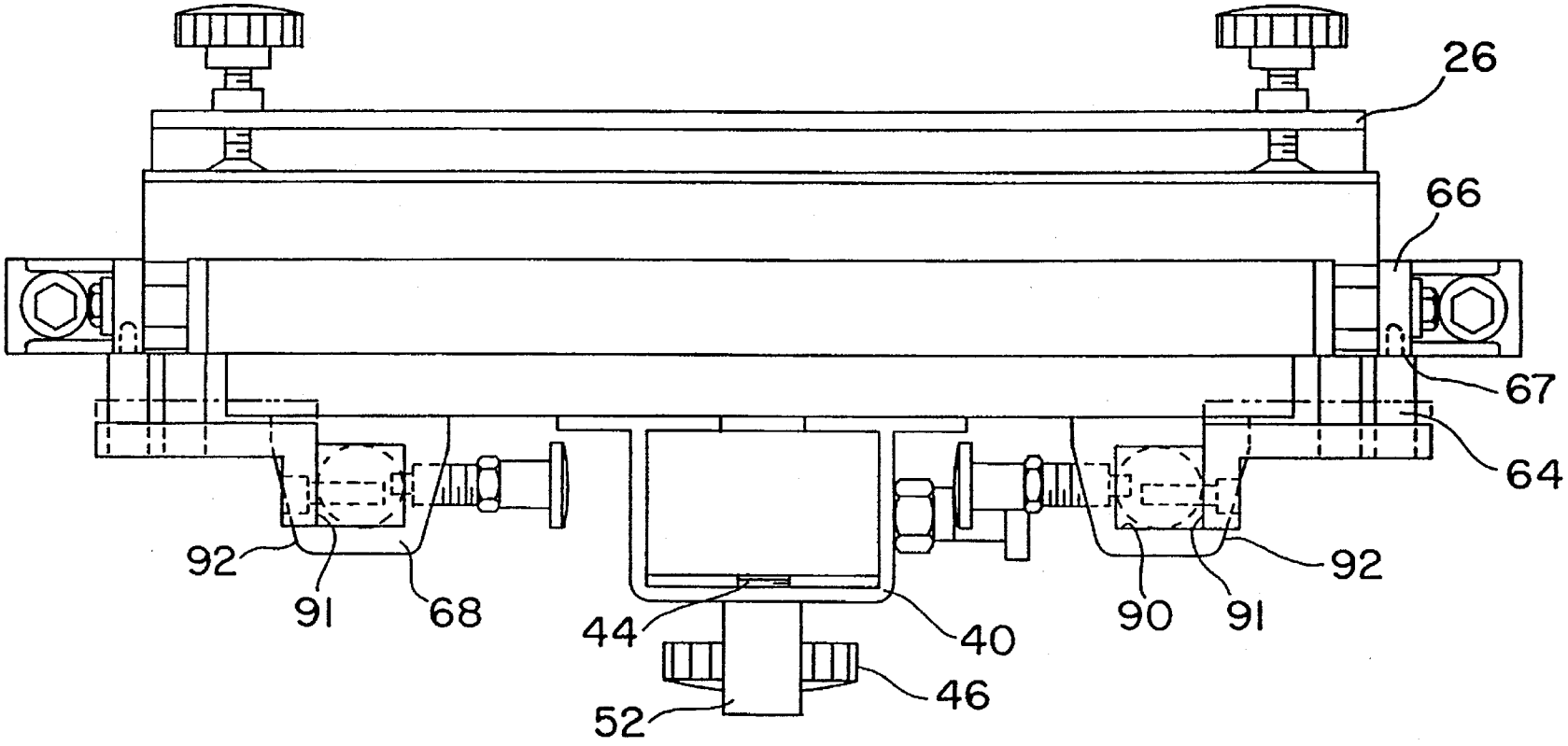
FIG. 5 is a front elevational view of the pallet with the registration appendages in the registered position and pins engaging the frame.

The retractable registration apparatus 10 is shown in a registration position in FIG. 2 for aligning the screen printing roller frame 28 in the printing machine 12. The screen printing roller frame 28 has corner members 66 having a hole or slot 67, as best seen in FIG. 5. U.S. patent application Ser. No. 08/143,791 which issued as U.S. Pat. No. 5,377,422 discloses a screen printing roller frame having an adapter having a hole and a slot and is herein incorporated by reference. The outer pins 64 on each finger 62, in this particular embodiment, are received by a hole or slot in the corner member 66 to align the screen printing roller frame 28 so that it may be secured in the U-shaped channel 26 of the frame holder 24.

Figure 3:
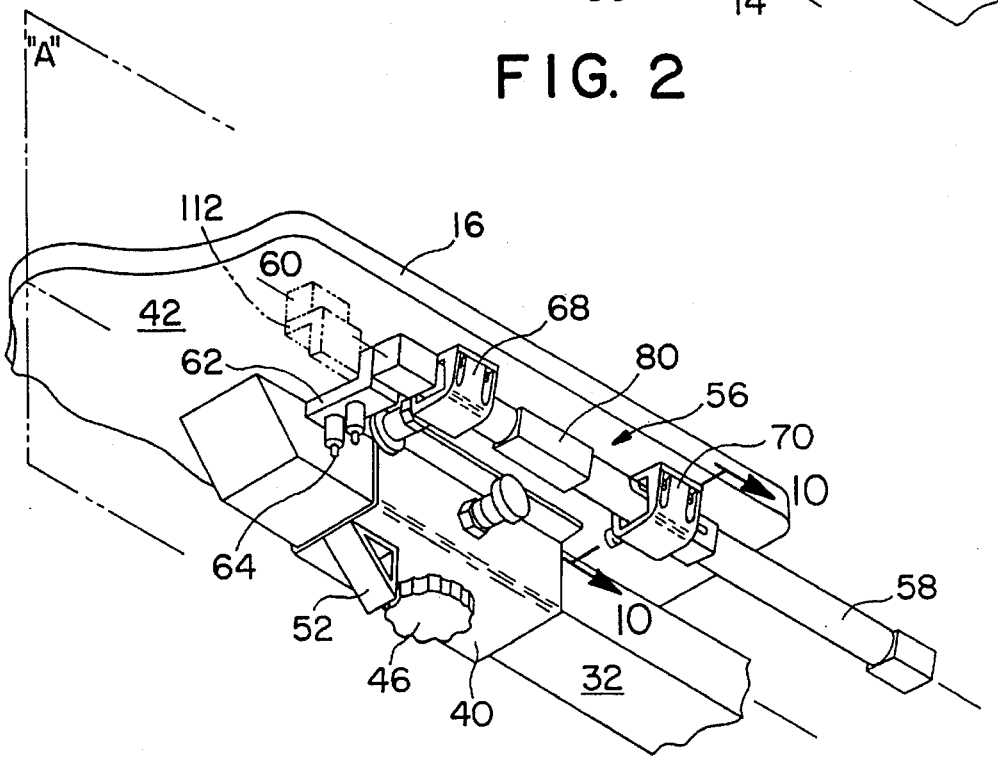
FIG. 3 is a bottom isometric view of a portion of the pallet with the registration appendages shown in a retracted position.

Referring to FIG. 3, the retractable registration apparatus 10 is shown in a retracted position allowing printing. In the retracted position, the pallet 14 can be used for printing without interference from the registration apparatus 10. Each of the arms 58 is mounted to the lower mounting surface 42 of the pallet 14 by a pair of mounting brackets 68 and 70. In that the registration appendages 56 are mirrored of each other, only one appendage 56 will be described.

Figure 4:
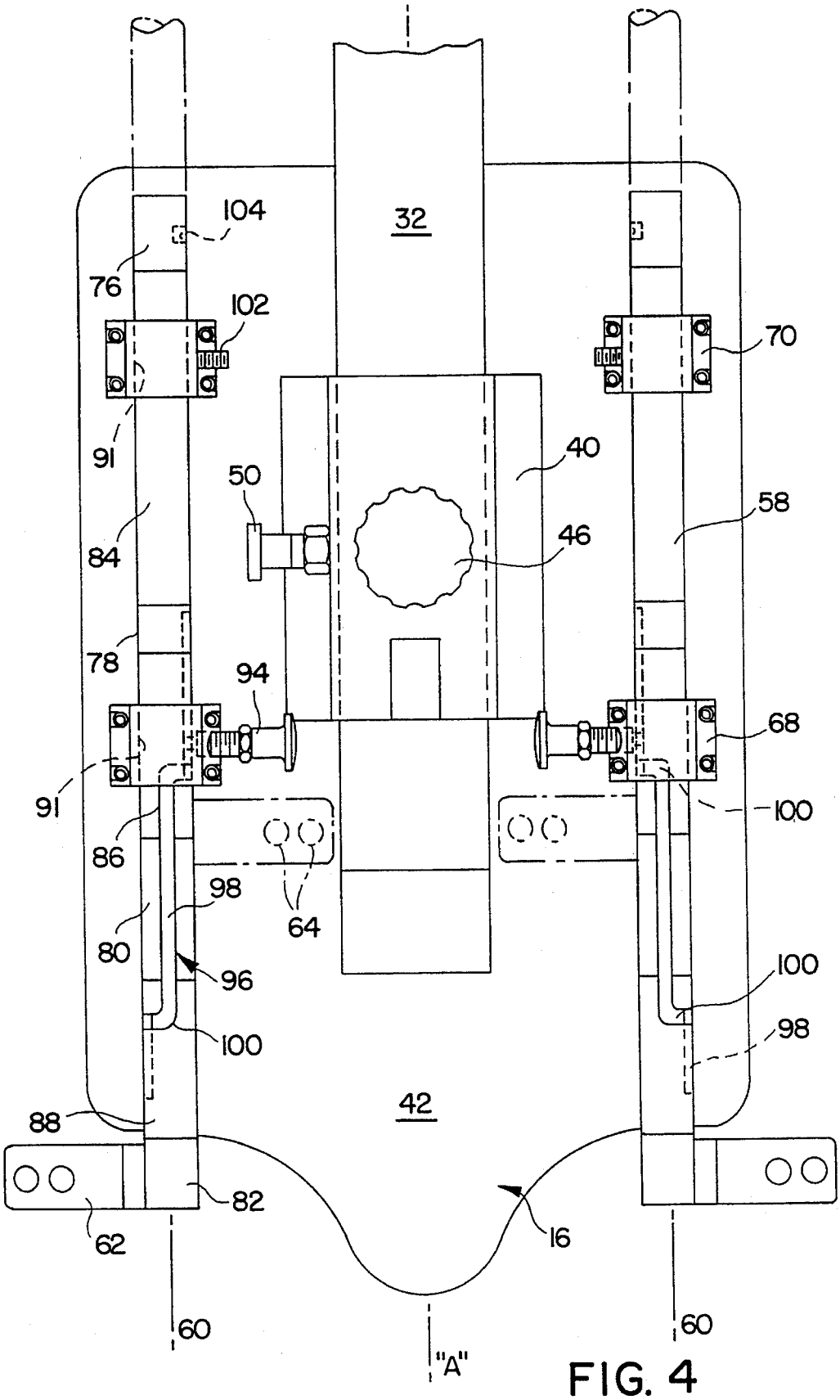
FIG. 4 is a bottom plan view of the pallet with the registration appendages in the registered position. The registration appendages are shown in phantom in the retracted position.

Referring to FIG. 4, the arm 58 has four sections that each have a square cross-section. The square cross-sections each have four edges 74 which are rounded, as seen in FIGS. 7–10. The four sections are a rear alignment section 76, a front alignment section 78, a sliding section 80 and a mounting section or portion 82. Between the rectangular cross-sections, the arm 58 has circular cross-sections which inscribe the square cross-sections. The circular cross-sections are a detent section 84, a second rotation section 86 and a first rotation section 88.

Referring to FIGS. 4 and 5, the mounting brackets 68 and 70 have a square opening, or bushing having an opening 90, for slideably receiving the square cross-sections 76, 78 and 80 of the arm 58. The mounting brackets 68 and 70 are mounted to the lower mounting surface 42 of the pallet 14 such that side walls 91 of each of the mounting brackets 68 and 70 are aligned in the same plane and parallel to the center line "A" of the pallet 14. In addition, the mounting brackets 68 and 70 each have a tapered outer wall 92 to ease the insertion of a shirt 16 on the pallet 14, as described below.

The front mounting bracket 68 has a tracking pin 94 to be received in a track 96 cut into the arm 58. The track 96 has longitudinal extending portions 98 for allowing translational movement of the registration appendage 56, including the arm 58 and the finger 62. In addition, the track 96 has portions 100 having a radial component for allowing rotation of the arm 58 and the finger 62 about the longitudinal axis 60.

Referring to FIG. 4, the back mounting bracket 70 has a detent mechanism, such as a detent 102 or a pull out plunger. The detent 102 aligns with a detent bushing 104, shown in hidden line, located on one of the sides of the square cross-section rear alignment section 76 of the arm 58 to retain the registration appendages 56 with the finger 62 in the registration position.

Figure 10:
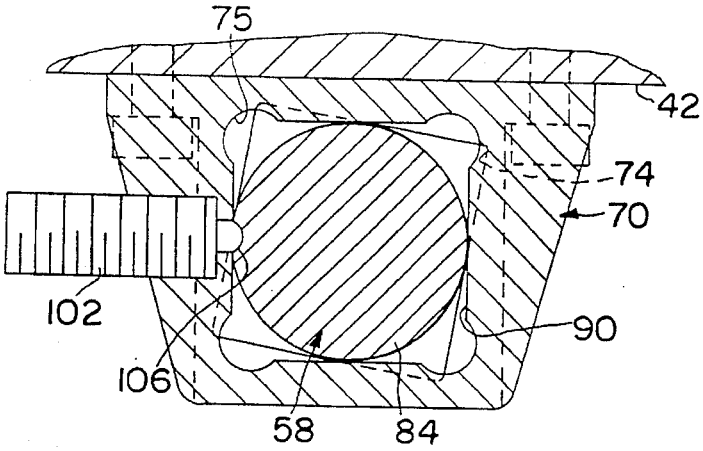
FIG. 10 is a sectional view of the arm and a rear mounting bracket taken along line 10—10 in FIG. 3.

Referring to FIG. 10, the detent 102 engages a dimple 106 on the detent section 84, a circle cross-section of the arm 58, to retain the registration appendages 56, including the finger 62 in the retracted position. The corners of the square opening 90 of the mounting brackets 68 and 70 are relieved by a ¾ circle cutout which allows the square cross-sections of the arm 58 to slide easily against the walls of the square opening 90 including the side walls 91. In addition, the square cross-section portions of the arm 58 have their edges broken or rounded to ease in the sliding of the arm 58 and reduce cost in manufacturing.

Figure 6:
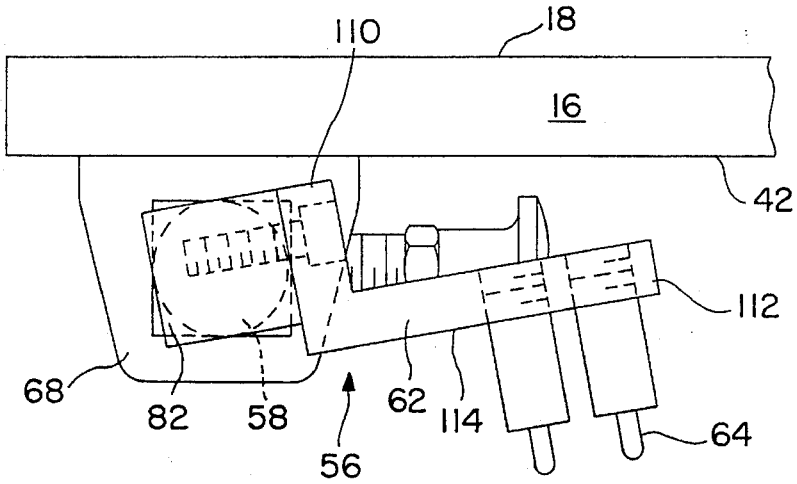
FIG. 6 is an enlarged broken out front elevation view of the finger and arm in the retracted position.

Referring to FIG. 6, the finger 62 has a leg segment 110 that is secured to the square cross-section mounting portion 82 of the arm 58 and a second leg section 112 that projects perpendicularly from the longitudinal axis 60 of the arm 58. The second leg section 112 has an upper surface 114 which is parallel to one of the sides of the square cross-section of the mounting portion 82 and spaced vertically therefrom.

When the registration appendage 56 is in the registration position as shown in FIG. 5, the upper surface 114 of the second leg 112 of the finger 62 can project above the lower mounting surface 42 of the pallet 14 as shown in phantom. Projecting from the upper surface 114 of the second leg segment 112 is the pair of registration pins 64. The preferred pins 64 are spring pins in which the pins can recede if they engage a hard surface, such as the screen printing roller frame 28.

In operation

Figure 7:
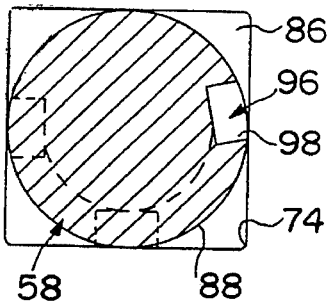
FIG. 7 is a sectional view of the arm taken along 7—7 in FIG. 2.

Referring to FIG. 3, when a screen printing roller frame 28 is to be aligned and secured to the frame holder 24 to set up for a printing operation, a printer grasps the fingers 62 located below the lower mounting surface 42 of the pallet 14 and pulls the registration appendages 56 towards him or herself. The tracking pin 94 of each registration appendage 56 follows the longitudinal portion 98 of the track 96, as shown in FIG. 7.

Figure 9:
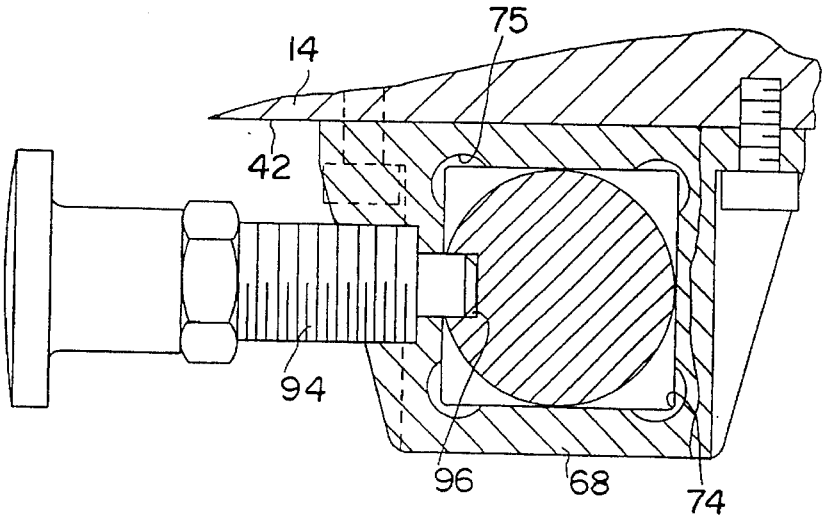
FIG. 9 is a sectional view of the arm and a front mounting bracket taken along line 9—9 in FIG. 2.

When the tracking pin 94 reaches the radial portion 100 of the track 96 in the first rotation section 88, referring to FIGS. 4 and 2, the printer rotates the finger 62 105°. After the rotation, the second leg segment 112 of the finger 62 is projecting downward and the square cross-sections of the arm 58 are aligned with the side walls 91 of the square opening 90 of the mounting brackets 68 and 70. The mounting brackets 60 and 70 each have reliefs 75 at the corners of the square opening 90 to ease movement, as seen in FIGS. 9 and 10.

Figure 8:
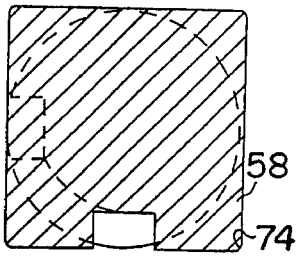
FIG. 8 is a sectional view of the arm taken along line 8—8 in FIG. 2.

Referring to FIG. 3 wherein the second leg segment 112 is shown in phantom projecting downward, and FIGS. 4 and 8, after the rotation of the arm 58 about the longitudinal axis 60, the sliding section cross-section 80 slides through the front mounting bracket 68 and the front alignment section 78 slides through the rear mounting bracket 70 moving the registration appendage 56 including arm 58 and finger 62 outward toward the printer. The tracking pin 94 reaches a second portion having a radial component 100, located in the second rotation section 86. The printer rotates the finger 62 about the longitudinal axis 60, such that the second leg segment 112 is parallel with the upper printing surface 18 of the pallet 14 as shown in FIGS. 2, 5 and 1.

Referring to FIGS. 2 and 5, upon the completion of this rotation, the tracking pin 94 reaches a portion of the track 96 that has strictly a longitudinal component 98. The arm 58 and finger 62 are pulled further outward until the registration appendages 56 reach the registration position. In the registration position, the detent 102 in the rear mounting bracket 70 engages the detent bushing 104 in the rear alignment section 76 therein securing the plurality of pins 64 in the proper position for alignment of the screen printing roller frame 28.

Referring to FIGS. 1 and 2, with the registration appendage 56 in proper position, the screen printing roller frame 28 is placed on the upper printing surface 18 of the pallet 14, with the pins 64 received by holes or slots 67 in the screen printing roller frame 28 by moving a flat bar from a substrate loading position to a printing position. With the screen printing roller frame 28 aligned, the frame holder 24 secures the roller frame 28. The movable bar 22 is raised upward lifting the screen printing roller frame 28 away from the pallet 14 and the pins 64.

The printing machine 12 is rotated such that a different frame holder 24 is located above the pallet 14 having the pin 64. The movable bar 22 associated with this different frame holder 24 is lowered down on the pallet 14. A second screen printing roller frame 28 is installed with the screen printing roller frame 28 located in the frame holder 24. The screen printing roller frame 28 is placed with the pins 64 of the registration appendages 56 received by holes or slots 67 in the screen printing roller frame 28. The process is repeated until all of the screen printing roller frame 28 are aligned and secured in the frame holder 24.

After all the screen printing roller frames 28 are aligned, the printer pushes the fingers 62 of the registration appendage 56 inward with the tracking pin 94 guided in the longitudinal portion 98 of the track 96 in the first alignment section 78 and second rotation section 86. When the tracking pin 94 reaches the radial component 100 of the track 96 in the second rotation section 86, the printer rotates the registration appendage 56 including the arm 58 90°.

The printer continues to push the fingers 62 inward with the tracking pin 94 following the longitudinal portion 98 of the track 96 in the second rotation section 86, the square cross-section sliding section 80 and the first rotation section 88. With the tracking pin 94 at the other radial component 100 of the track 96 in the first rotation section 88, the registration appendage 56 is rotated 105° until the finger 62 is in the retracted position 62 as shown in FIG. 6.

The printer continues to slide the registration appendage 56 inward until the arm 58 is retained in the retracted position 62 by the detent 102 being received by the dimple 106, as shown in FIG. 10. The registration appendage 56 is shown in the retracted position in FIG. 3 and in phantom in FIG. 4. In order to ease the finding of both the detent bushing 104 and the dimple 106 by the detent 102, the track 96 is cut in the arm 58 such that the ends of the track 96 extend beyond where the detent 102 would be located in the retracted position and the registered position by just hundredths of inches.

The printer then slides the article such as a shirt 16 onto the pallet 14 with the taper outer walls 92 of the mounting brackets 68 and 70 and in addition the angle bracket 52 of the U-shaped bracket 40 creating surfaces that will minimize the likelihood that the shirt 16 will get caught upon installation. The fingers 62 and the pins 64 of the registration appendages 56 are located between the arm 58 and the pillar arm 32 so as not to interfere with the sliding of the shirt onto the pallet 14.

The printer lowers the frame holder 24 containing the screen printing roller frame 28 and passes a squeegee across the screen 30 to place an image on the shirt 16. The screen printing roller frame 28 and frame holder 24 are separated from the pallet 14 and the printing machine 12 is rotated such that another screen printing roller frame 28 containing a different image on screen 30 is located above the pallet 14 containing the shirt 16 and the printing process continues.

Alternative Embodiments

Figure 11:
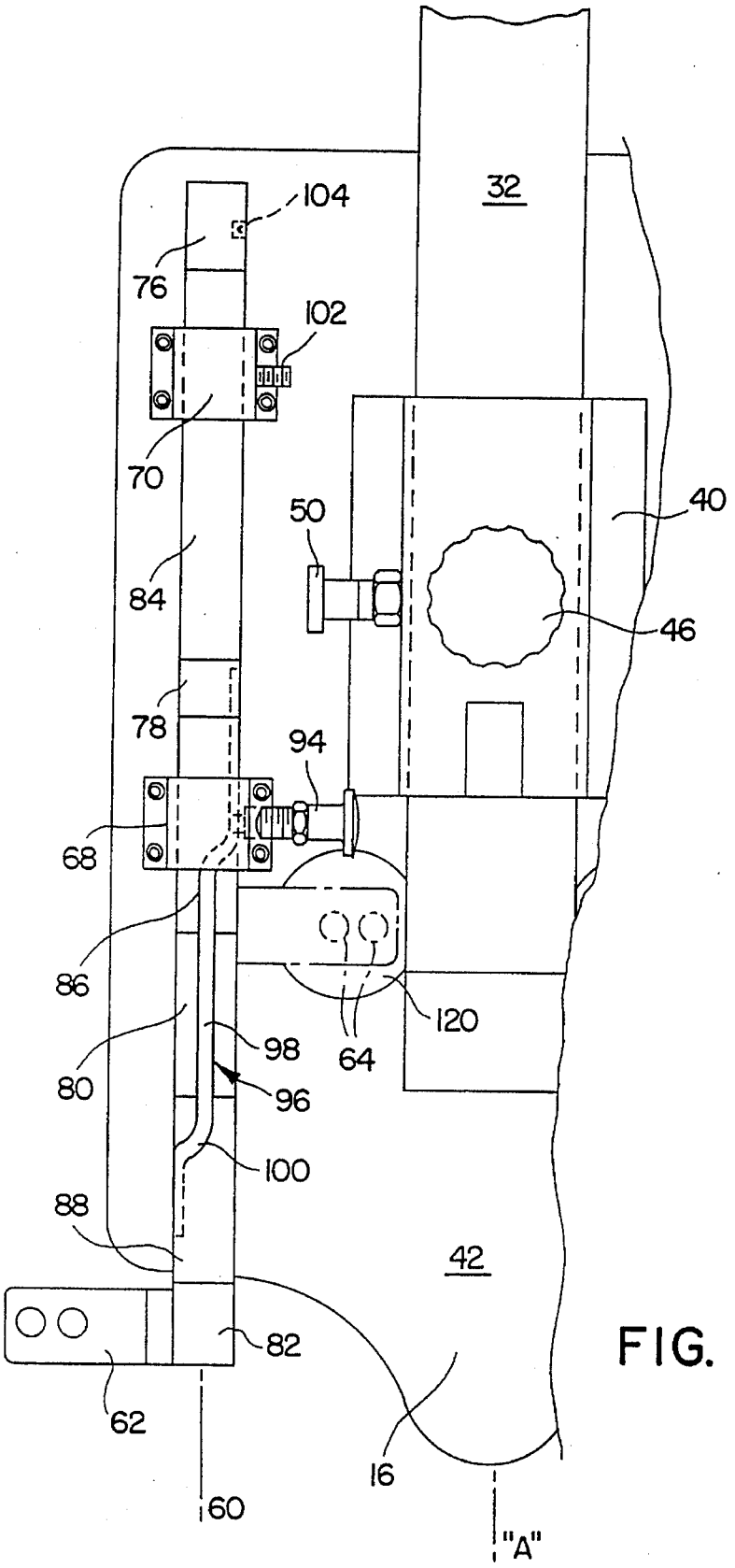
FIG. 11 is a bottom plan view of the pallet with the registration appendages in the registered position showing an alternative track.

Referring to FIG. 11, the radial component 100 of the track 96 has a longitudinal component 98. With the radial component 100 having the longitudinal component 98, the arm 58 of the registration appendage 56 will slide more smoothly between the retracted position and the registration position. The track 96 will guide the printers movement of the registration appendage 56.

In addition, the pallet 14 has a depression 120 cut into the lower mounting surface 42. The depression 120 allows the finger 62 to be rotated further, therein decreasing the likelihood that the pins 64 which project from the finger 62 will inadvertently catch on the shirt 16 being slid onto the pallet 14 to be printed on.

Figure 12:
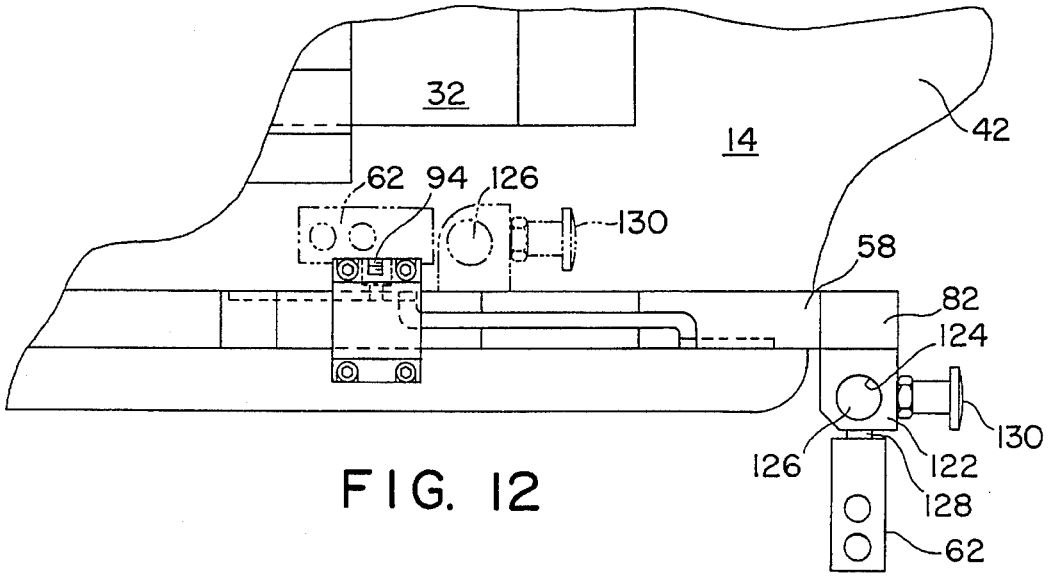
FIG. 12 is a bottom plan view of the pallet with the registration appendages showing an alternative finger in the registration position. The finger is shown in phantom in the retracted position.
Figure 13:
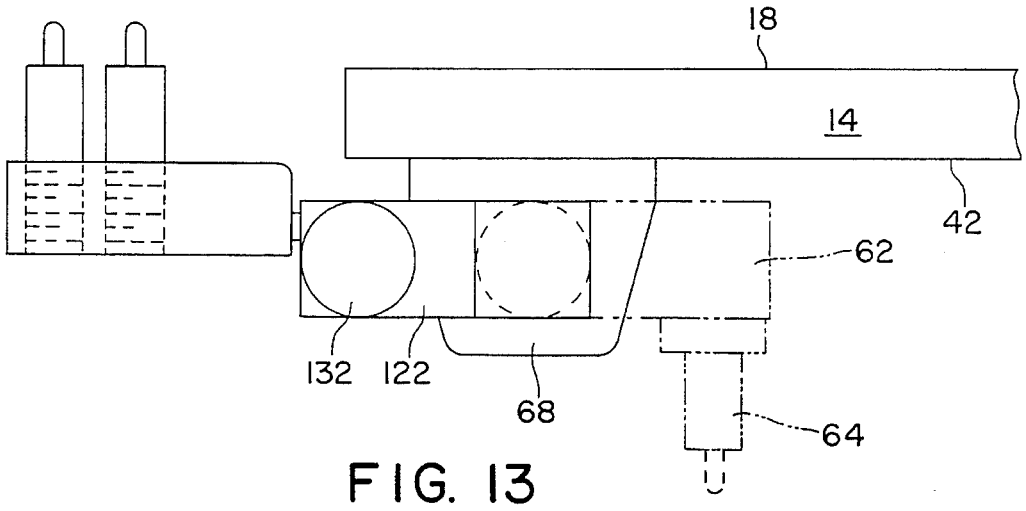
FIG. 13 is an enlarged broken out front elevational view of the finger and arm in the registration position of the alternative embodiment shown in FIG. 12. The finger is shown in phantom in the retracted position.

Referring to FIGS. 12 and 13, the finger 62 is pivotably mounted to the mounting section 82 of the arm 58. The mounting section 82 has an extension 122. The extension 122 has a bore 124 for receiving a pivot 126. The finger 62 has a hinge arm 128 that is connected to the pivot 126. The finger 62 rotates between an extended registration position and a rotated retracted position shown in phantom in FIGS. 12 and 13. The extension 122 has a detent plunger 130 for engaging detent dimples, not shown, on the pivot for retaining the finger 62 in its two positions. This embodiment allows the pins 64 to extend further outward without the finger 62 interfering with the pallet arm 32 when in the retracted position. A different type tracking pin 94 is shown in FIG. 12 which does not extend as far outward towards the pallet arm and therefore does not interfere with the rotated finger 62.

Figure 14:
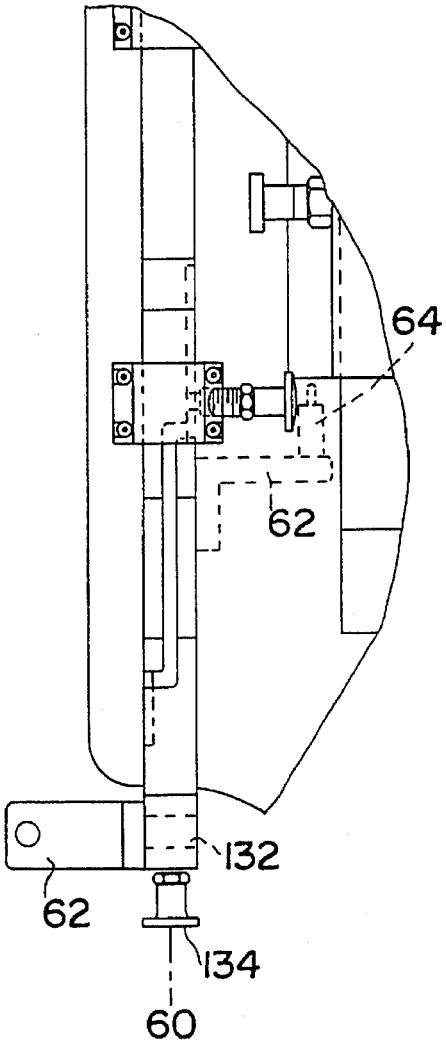
FIG. 14 is a broken out bottom plan view of the pallet with the registration appendages showing an alternative finger in the registration position. The finger is shown in phantom in the retracted position.

It is also realized that the finger 62 could be attached to the arm 58 such that the finger 62 can rotate relative to the arm 58, perpendicular to the longitudinal axis 60 of the arm 58 by having a cylindrical shaft 132, as shown in hidden line in FIG. 14, extending through the mounting section 82 of the arm 58. A detent mechanism 134 would hold the finger 62 in an extended position or a retracted position. For example, the finger 62 could be rotated 90° so that the pins are perpendicular to the printing surface therein not interfering with the installation of a shirt 16 for printing as shown in phantom in FIG. 14.

It is also recognized that the finger 62 could have a telescoping arrangement. The telescoping arrangement would allow the pins to be extended further outward in the registration position, but not interfere with the pallet arm 32 in the retracted position.

While each arm 58 is shown with a track 96, and separate detent bushing 104 and dimple 106, the track 96 could have locations where the track is cut deeper than the rest of the track. These two locations therein forming each a detent and the tracking pin 94 could act as both the tracking pin and the detent.

Figure 15:
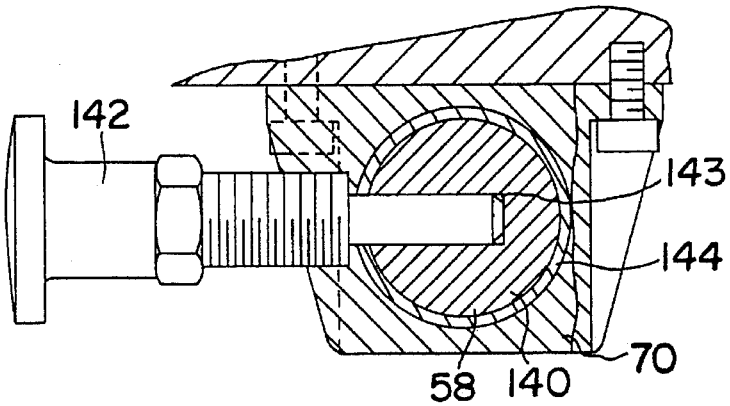
FIG. 15 is a sectional view of an alternative embodiment of the arm and mounting bracket.

It is recognized that while the registration appendage 56 has been shown having both square cross-sections and circular cross-sections, the arm could be a uniform circular cross-section 140 as shown in FIG. 15. With the uniform circular cross-section 140, the tracking pin 94 guides the movement of the arm 58 as in the previous embodiment. A detent 142 extends into a hole 143 in the circular cross-section 140 to hold the registration appendage 56 in the registration position. Since the square cross-section of the arm 58 in the square opening 90 of the previous embodiment assisted in the prevention of rotation of the arm 58 and such assistance is not available in this embodiment, the hole 143 and the detent 142 is larger to maintain the arm 58 in the registration position. The rear mounting bracket 70 has a brass sintered bushing 144 through which the arm 58 with the uniform circular cross-section 140 slides.

It is recognized that while a tracking pin received in a track to guide the movement of the arm 58, it may be desirable for ease in manufacturing to eliminate the track. If a printer knows the general positions of the retracted position and the registration position, all that would be required in the arm would be the pair of holes which receive detent 142 to align the registration bracket.

The present invention may be embodied in other specific forms without departing from the spirit or essential attributes thereof and, accordingly, reference should be made to the appended claims, rather than to the foregoing specification, as indicating the scope of the invention. For example, the arms of the registration appendages 56 could be pivotably mounted to the lower mounting surface 42 of the pallet 14. The arms would rotate about a point from the retracted position to the registered position.

The present invention may be embodied in other specific forms without departing from the spirit or essential attributes thereof and, accordingly, reference should be made to the appended claims, rather than to the foregoing specification, as indicating the scope of the invention.

I claim:

1. A retractable registration apparatus for aligning a printing screen frame with an image platform, the apparatus comprising:

a pair of registration pins for engaging the printing screen frame;

an arm associated with each pin, the arms adapted for being carried by the image platform;

rotating means adapted for allowing rotation of the pins from a registration position to a retracted position;

means adapted for allowing movement of the arms and the registration pins between the registration position and the retracted position;

retaining means for retaining the arms and the registration pins in the retracted position; and locking means for locking in the exact registration position the arms and the registration pins.

2. A retractable registration apparatus for aligning a printing screen frame with an image platform having an upper printing surface and a lower surface for coupling with a pillar of a printing machine along a center line of the image platform, the apparatus comprising:

a pair of arms, each arm having a longitudinal axis;

at least one mounting bracket associated with each of the arms, the mounting brackets each having an opening extending through the bracket for slideably receiving the arm allowing longitudinal translational movement of the arm between a retracted position and a registration position;

a finger extending from each of the arms, each finger having at least one registration pin for registration with the screen frame;

means for retaining the arms and the registration pins in the retracted position; and a detent means for retaining in the registration position the arms and the registration pins for aligning the screen frame.

3. A retractable registration apparatus as in claim 2 wherein at least one of the arms has a track formed within the arm, and one of the mounting brackets associated with the arm has a guide pin projecting into the arm for guiding the movement of the arm.

4. A retractable registration apparatus as in claim 3 wherein the track has portions with a longitudinal component for movement of the arm in a translational movement and has portions having a radial component for rotation of the arm about the longitudinal axis.

5. A retractable registration apparatus as in claim 4 further comprising the image platform, wherein there is a pair of mounting brackets associated with each of the arms, and each of the pairs of mounting brackets are mounted to the lower surface of the image platform so that the longitudinal axis of the arms are parallel to the center line of the image platform.

6. A retractable registration apparatus for aligning a printing screen frame in a printing machine having a pillar, the apparatus comprising:

an image platform having an upper printing surface and a lower surface, the image platform having a center line;

a bracket mounted to the lower surface of the image platform along the center line of the image platform and adapted for receiving the pillar of the printing machine;

a pair of arms, each arm having a longitudinal axis;

each arm having at least two sections with a substantially square cross-section along the longitudinal axis and at least two other sections along the longitudinal axis having a cross-section that is no greater than a circular cross-section inscribed within the square cross-section;

a pair of mounting brackets associated with each of the arms, the mounting brackets each having a substantially square opening extending through the bracket for slideably receiving the substantially square cross-section of the arm, the substantially square opening having a pair of side walls, the pair of mounting brackets mounted to the lower surface of the image platform so that one of the side walls of each bracket is aligned in the same plane and is parallel to the center line;

each arm having a track formed within the arm, and one of the mounting brackets associated with the arm having a guide pin projecting into the arm for guiding the movement of the arm, the track having portions with a longitudinal component for movement of the arm in a translational movement and having portions having a radial component for rotation of the arm about the longitudinal axis;

a finger extending from the arm, the finger having at least one registration pin for registration with the screen frame;

means for retaining the arms and the registration pins in the retracted position; and a detent means for retaining in the exact registration position the arms and the registration pins for aligning the screen frame.

7. A retractable registration apparatus as in claim 6 wherein the cross-section that is no greater than the circular cross-section is a circular cross-section inscribed within the square cross-section.

8. A retractable registration apparatus as in claim 7 wherein the substantially square cross sections of the arms have rounded edges.

9. A retractable registration apparatus as in claim 8 wherein the substantially square opening of the mounting bracket has reliefs in the corners such that the reliefs are spaced for non-engagement relationship with the arms.

10. A retractable registration apparatus as in claim 7 wherein the tracks have components in which each component is either only radial or only longitudinal.

11. A retractable registration apparatus as in claim 7 wherein the portion of the track that has the radial component has also a longitudinal component.

12. A retractable registration apparatus as in claim 7 wherein the mounting brackets each have a tapered outer wall.

13. A retractable registration apparatus as in claim 7 wherein the arms are symmetric with each other about the center line of the image platform.

14. An apparatus for aligning a printing screen frame to a printing machine, the apparatus comprising:

a pallet arm;

a frame holder movable relative to the pallet arm between a printing position and a substrate loading position, the frame holder having a means for retaining the screen frame;

a pallet having an upper printing surface and a lower mounting surface, and a center plane extending longitudinally, bisecting the pallet and the upper and lower surfaces;

a bracket mounted to the lower mounting surface of the pallet along the center plane for receiving the pallet arm;

a pair of arms, each arm having a longitudinal axis;

each arm having at least three sections with a substantially square cross-section along the longitudinal axis and at least three sections along the longitudinal axis having a circular cross-section inscribed within the square cross-section;

a pair of mounting brackets associated with each of the arms, the mounting brackets each having a substantially square opening extending through the bracket for slideably receiving the substantially square cross-section of the arm, the substantially square opening having a pair of side walls, the pair of mounting brackets mounted to the lower surface of the pallet so that one of the side walls of each bracket is aligned in the same plane and is parallel to the center plane and the mounting brackets for each arm symmetric with each other about the center plane of the pallet;

each arm having a track formed within the arm, and one of the mounting brackets associated with the arm having a guide pin projecting into the arm for guiding the movement of the arm, the track having portions with a longitudinal component for movement of the arm in a translational movement and having portions having a radial component for rotation of the arm about the longitudinal axis of the arm;

a finger extending from the arm, the finger having at least one registration pin for registration with the screen printing frame;

means for retaining the arms and the registration pins in the retracted position for non-inference by the registration pins and fingers with printing; and a detent means for retaining in the exact registration position the arms and the registration pins for aligning the screen frame.

15. An apparatus as in claim 14 wherein the substantially square cross sections of the arms have rounded edges.

16. An apparatus as in claim 15 wherein the substantially square opening of the mounting bracket has reliefs in the corners such that the reliefs are spaced for non-engagement with the arms.

17. An apparatus as in claim 14 wherein the tracks have components in which each component is either only radial or only longitudinal.

18. An apparatus as in claim 14 wherein the portion of the track that has the radial component has also a longitudinal component.

19. An apparatus as in claim 14 wherein the mounting brackets each have a tapered outer wall.

20. An apparatus as in claim 14 further comprising means for rotatably mounting the finger to the longitudinal axis of the arm for movement between a registration position and a retracted position.

21. An apparatus as in claim 14 further comprising means for pivotally mounting the finger to the arm for movement between a registration position and a retracted position.

22. A retractable registration apparatus mounted on a printing machine for aligning a printing screen frame, the apparatus comprising:

a pair of arms, each arm having a longitudinal axis;

at least one mounting bracket associated with each of the arms, the mounting brackets each having an opening extending through the bracket for slideably receiving the arm allowing longitudinal translational movement of the arm between a retracted position and a registration position, each mounting bracket adapted to be carried by the printing machine;

a finger extending from each of the arms, each finger having at least one registration pin for registration with the screen frame;

means for retaining the arms and the registration pins in the retracted position; and a detent means for retaining in the registration position the arms and the registration pins for aligning the screen frame.

23. A retractable registration apparatus as in claim 22 wherein at least one of the arms has a track formed within the arm, and one of the mounting brackets associated with the arm has a guide pin projecting into the arm for guiding the movement of the arm.

24. A retractable registration apparatus as in claim 23 wherein the track has portions with a longitudinal component for movement of the arm in a translational movement and has portions having a radial component for rotation of the arm about the longitudinal axis.

25. A retractable registration apparatus as in claim 24 further comprising an image platform having an upper printing surface and a lower surface, the image platform mounted to the printing machine, wherein there is a pair of mounting brackets associated with each of the arms, and each of the pairs of mounting brackets are mounted to the lower surface of the image platform so that the longitudinal axis of the arms are parallel to a center line of the image platform.

* * * * *